US008692148B1

(12) United States Patent
Sommer, Jr. et al.

(10) Patent No.: US 8,692,148 B1
(45) Date of Patent: Apr. 8, 2014

(54) METHOD AND APPARATUS FOR IMPROVING PERFORMANCE IN CONTAINER SORTING

(75) Inventors: Edward J. Sommer, Jr., Nashville, TN (US); R. Lynn Conley, Antioch, TN (US); Robert H. Parrish, Nashville, TN (US)

(73) Assignee: National Recovery Technologies, LLC, Nashville, TN (US)

( * ) Notice: Subject to any disclaimer, the term of this patent is extended or adjusted under 35 U.S.C. 154(b) by 179 days.

(21) Appl. No.: 13/183,200

(22) Filed: Jul. 14, 2011

Related U.S. Application Data

(60) Provisional application No. 61/399,865, filed on Jul. 19, 2010.

(51) Int. Cl.
*B07C 5/342* (2006.01)

(52) U.S. Cl.
USPC ..... 209/576; 209/587

(58) Field of Classification Search
USPC ..... 209/576, 587
See application file for complete search history.

(56) References Cited

U.S. PATENT DOCUMENTS

| | | | | |
|---|---|---|---|---|
| 4,090,074 | A | 5/1978 | Watt et al. | |
| 4,377,392 | A | 3/1983 | Massey et al. | |
| 4,486,894 | A | 12/1984 | Page et al. | |
| 4,626,688 | A | 12/1986 | Barnes | |
| 4,848,590 | A | 7/1989 | Kelly | |
| 5,176,260 | A | 1/1993 | Oder | |
| 5,676,256 | A | 10/1997 | Kumar et al. | |
| 5,738,224 | A | 4/1998 | Sommer, Jr. et al. | |
| 5,818,899 | A | 10/1998 | Connolly et al. | |
| 5,841,832 | A | 11/1998 | Mazess et al. | |
| 5,841,833 | A | 11/1998 | Mazess et al. | |
| 5,931,308 | A | 8/1999 | Gesing et al. | |
| RE36,537 | E | 2/2000 | Sommer, Jr. et al. | |
| 6,060,677 | A * | 5/2000 | Ulrichsen et al. | 209/577 |
| 6,122,343 | A | 9/2000 | Pidcock | |
| 6,128,365 | A | 10/2000 | Bechwati et al. | |
| 6,266,390 | B1 | 7/2001 | Sommer, Jr. et al. | |
| 6,272,230 | B1 | 8/2001 | Hiraoglu et al. | |
| 6,338,305 | B1 | 1/2002 | McHenry et al. | |
| RE37,536 | E | 2/2002 | Barnes | |
| 6,353,197 | B1 * | 3/2002 | Ulrichsen et al. | 209/577 |
| 6,399,951 | B1 | 6/2002 | Paulus et al. | |
| 6,519,315 | B2 | 2/2003 | Sommer, Jr. et al. | |
| 6,545,240 | B2 * | 4/2003 | Kumar | 209/579 |
| 6,587,575 | B1 * | 7/2003 | Windham et al. | 382/110 |
| 6,610,981 | B2 | 8/2003 | Sommer, Jr. | |
| 6,661,867 | B2 | 12/2003 | Mario et al. | |
| 6,855,901 | B1 | 2/2005 | Guenard et al. | |
| 6,888,917 | B2 | 5/2005 | Sommer, Jr. et al. | |
| 7,012,256 | B1 | 3/2006 | Roos et al. | |
| 7,099,433 | B2 | 8/2006 | Sommer, Jr. et al. | |
| 7,200,200 | B2 | 4/2007 | Laurila et al. | |
| 7,244,941 | B2 | 7/2007 | Roos et al. | |
| 7,262,380 | B1 * | 8/2007 | Ulrichsen et al. | 209/577 |
| 7,286,634 | B2 | 10/2007 | Sommer, Jr. et al. | |
| 7,356,115 | B2 | 4/2008 | Ford et al. | |

(Continued)

*Primary Examiner* — Terrell Matthews
(74) *Attorney, Agent, or Firm* — Wyatt, Tarrant & Combs, LLP

(57) ABSTRACT

The present invention discloses a container sorting system capable of increased sorting efficiency. The present invention discloses a device in which the distance is shortened between detection and ejection of containers being sorted by reflective infrared radiation, transmission infrared radiation, or both. The present invention also includes a method of operating such device.

10 Claims, 3 Drawing Sheets

(56) References Cited

U.S. PATENT DOCUMENTS

| | | | |
|---|---|---|---|
| 7,542,873 | B2 | 6/2009 | Vince et al. |
| 7,558,370 | B2 | 7/2009 | Sommer, Jr. et al. |
| 7,564,943 | B2 | 7/2009 | Sommer, Jr. et al. |
| 7,664,225 | B2 | 2/2010 | Klein |
| 7,848,484 | B2 | 12/2010 | Sommer, Jr. et al. |
| 2004/0066890 | A1 | 4/2004 | Dalmijn et al. |
| 2010/0185319 | A1 | 7/2010 | Petzold |
| 2011/0116596 | A1 | 5/2011 | Sommer, Jr. et al. |

* cited by examiner

METHOD AND APPARATUS FOR IMPROVING PERFORMANCE IN CONTAINER SORTING

This application claims the benefit of U.S. Provisional Patent Application Ser. No. 61/399,865, filed Jul. 19, 2010, entitled "Method and Apparatus for Improving Performance in Container Sorting" which is hereby incorporated by reference in its entirety.

Be it known that we, Edward J. Sommer, Jr., a United States citizen, residing at 5329 General Forrest Court, Nashville, Tenn. 37215, R. Lynn Conley, a United States citizen, residing at 8045 Maggie Court, Antioch, Tenn. 37013, and Robert H. Parrish, a United States citizen, residing at 8029 Settlers Way, Nashville, Tenn. 37221, have invented a new and useful "Method and Apparatus for Improving Performance in Container Sorting."

STATEMENT REGARDING FEDERALLY SPONSORED RESEARCH OR DEVELOPMENT

Not applicable

REFERENCE TO A MICROFICHE APPENDIX

Not applicable

BACKGROUND OF THE INVENTION

As the general public continues to increase its willingness to recycle, there are a variety of reasons that would lead to the desire for a container sorting system having improved efficiency. Currently available sorting system are plagued with many shortcomings. Traditional sorting systems use sensing devices which are bulky and have traditionally been configured to sort materials with a conveyor belt as a backdrop. Sensing systems in this configuration receive signals from the conveyor belt as well as from the items to be sorted which can complicate the identification of items. The traditional configuration of sorting systems also has resulted in a significant distance being present between the sensing region and the sorting region of a system. Given that many of the items being sorted are light weight cylindrically shaped bottles, one can imagine the movement of such individual items on the surface of a rapidly moving conveyor belt. Unfortunately, such lateral movement and variations in acceleration result in a complicated and hard to predict path of travel for such an item as it passes from a sensing region over a significant distance to a sorting region. If the item does not reach the sorting region at the time and location at which it is expected, then the sorting system has failed. The result is that sorting is not being performed in an efficient manner.

SUMMARY OF INVENTION

Disclosed herein is a container sorting system capable of improved sorting efficiency. As further described herein, the present invention eliminates interference signals from a conveyor belt and also allows for the distance between the sensing region and ejection region of the system to be only a minimal distance. Also disclosed herein is a method of sorting containers by use of the disclosed device.

The sorting device for sorting materials according to composition includes an infrared radiation source, a conveyor, wherein the conveyor has a discharge end, an infrared radiation sensing system positioned to receive and detect infrared radiation reflected off a sample while the sample is located immediately off the discharge end of the conveyor and is irradiated with infrared radiation from the infrared radiation source, a first processing system operationally connected to the infrared radiation sensing system so that the detected infrared radiation signals are analyzed to determine composition of the sample, an ejection system positioned immediately downstream from the infrared radiation sensing system, a second processing system operationally connected to the ejection system so that sample having certain composition may be ejected out of the flow path by the ejection system, and a receiving station positioned to receive ejected sample. In certain embodiments, the infrared radiation sensing system is located a minimal distance downstream from the discharge end of the conveyor. In other embodiments, the ejection system is located a minimal distance downstream from the infrared radiation sensing system. In yet other embodiments, the first processing system and the second processing system are combined into a single processing system. Also disclosed herein is a sorting device for sorting materials according to composition which includes an infrared radiation source, a conveyor, wherein the conveyor has a discharge end, an infrared radiation sensing system positioned to receive and detect infrared radiation reflected off a sample while the sample is located immediately off the discharge end of the conveyor and is irradiated with infrared radiation from the infrared radiation source, a processing system operationally connected to the infrared radiation sensing system so that the detected infrared radiation signals are analyzed to determine composition of the sample, an ejection system operationally connected to the processing system so that a sample having a certain composition may be ejected out of the flow path, wherein the ejection system is positioned immediately downstream from the infrared radiation sensing system, and a receiving station positioned to receive ejected sample. In certain embodiments, the device further includes a transmission infrared radiation source positioned so that the infrared radiation sensing system receives and detects infrared radiation transmitted through the sample while the sample is located immediately off the discharge end of the conveyor and is irradiated with infrared radiation from the transmission infrared radiation source.

Also disclosed herein is a method of sensing and sorting materials according to composition which includes providing a sample, placing the sample on a conveyor having a discharge end, placing the sample in an infrared radiation sensing region, wherein the infrared radiation sensing region is located immediately off the discharge end of the conveyor, irradiating the sample to be sorted with infrared radiation in the sensing region, detecting infrared radiation signals reflected off the sample while the sample is in the sensing region, analyzing the infrared radiation signals to determine composition of the sample, and energizing at least one air ejector of an air ejection array, wherein the air ejection array is located immediately downstream from the infrared radiation sensing region. In certain embodiments, the infrared radiation sensing region is located at a minimal distance from the discharge end of the conveyor. In other embodiments, the air ejection array is located at a minimal distance downstream from the infrared radiation sensing region. In still other embodiments, the method further includes detecting infrared radiation signals transmitted through the sample while the sample is in the sensing region.

Accordingly, one object of the present invention is to provide a sorting system having only a minimal distance between the sensing region and the ejection region.

Another object of the present invention is to provide a sorting system having an improved sorting efficiency. Yet another object of the present invention is to provide a sorting system that minimizes interference signals from a conveyor belt surface.

Still another object of the present invention is to provide a method of sorting containers that does not require regular cleaning of a conveyor belt surface.

Yet another object of the present invention is to provide a method of sorting containers that does not pose a fire hazard to the facility in which the sorting system is located.

Still another object of the present invention is to provide a sorting system having the capability to sort with reflected infrared radiation, transmission infrared radiation, or both.

DESCRIPTION OF THE PREFERRED EMBODIMENTS

Figure 1:
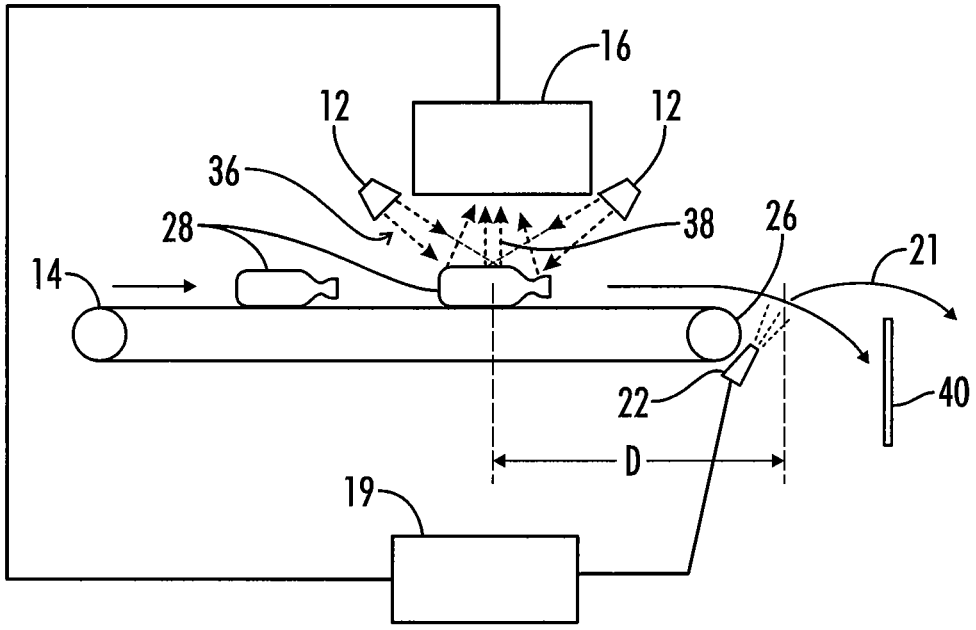
FIG. 1 is a schematic diagram of a side view of a currently available sorting system. Shown therein is the traditional positioning of a sensing region on a conveyor which is separated by a significant distance ("D") from the ejection region.

The present invention is an infrared radiation sorting system that overcomes the flaws of currently available reflective infrared sorting systems. The infrared radiation sorting system, referred to as the system 10, includes an infrared radiation source 12, conveyor 14, infrared radiation sensing system 16, first processing system 18, second processing system 20, an ejection system 22, and a receiving station 24. Also disclosed herein is a method of using the system 10 to more efficiently sort materials according to composition.

Currently available material sorting systems that operate in the near infrared range (1.0-2.5 microns) and sense infrared radiation reflected off a material item (such as a plastic bottle) operate in a configuration where the sensing system is positioned over a conveyor 14 belt, as best seen in FIG. 1. In this configuration samples 28 on the conveyor 14 pass under the sensing system 16 where they are irradiated with infrared radiation 36 from an infrared radiation source 12 and the sensing system 16 monitors the infrared radiation reflected 38 off the sample 28. Currently available systems are not desirable due to the distance between the infrared radiation sensing region and ejection region. That is, an item to be ejected must travel the distance ("D") between detection in the sensing region and ejection location. Typically this distance can be several feet (e.g. 3-4 feet). An item to be ejected can roll, bounce, or otherwise be disturbed when being conveyed the distance from detection to ejection. Such disturbances can change the position and/or speed of the item causing problems in ejection. If the item is rolling then it can be conveyed at a speed different (generally slower) than the conveyor 14 belt speed causing it to arrive at the ejection location before or after the ejector is fired since the processor system 19 expects the item to be conveyed at the speed of the conveyor 14.

Figure 2:
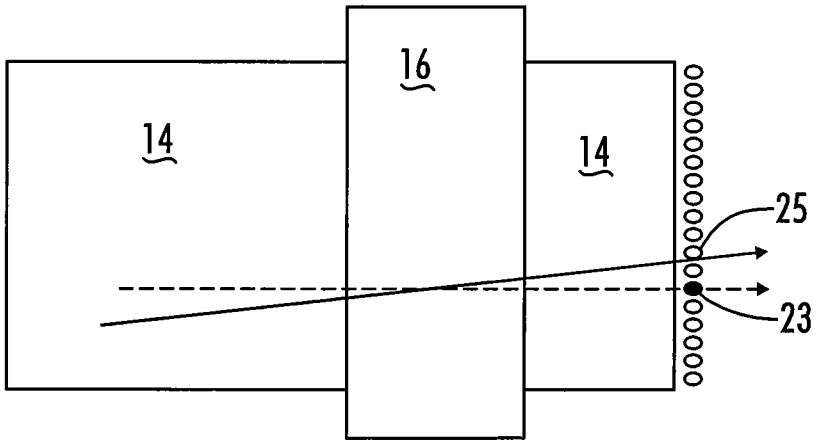
FIG. 2 is a schematic diagram showing a top view of the sorting system shown in FIG. 1. Shown therein is a flaw of the traditional system in that the distance between the sensing region and the ejection region is long enough to allow an item being sorted to move along its actual path (solid arrow) rather than its expected path (dashed arrow) such that the item is not properly sorted. The shaded ejector represents the ejector that was fired to sort the item.

Another disadvantage of current systems is that if the conveyed item has a lateral velocity component then it can move into an adjacent region on the conveyor 14 belt upon arrival at the ejection location and be missed by the firing of the air ejectors in the ejection channel directly downstream along the item expected path of travel determined at the time of detection in the sensing region. Stated another way, as best seen in FIG. 2, there is an actual path of travel (shown by a solid arrow) of an item which differs from the expected path of travel (shown by a dashed arrow). The sorting system fires an ejector 23 at the expected time/location in order to separate the item by giving it a trajectory path 21 over the splitter 40. However, because the actual path of travel of the item to be ejected differs, the item passes over the ejector not fired 25. Referring back to FIG. 1, the significant distance between the location of detection and location of ejection results in less than optimal sorting.

Still another disadvantage of traditional sorting systems in recycling plants is that there is typically a build up of foreign materials (dirt, grime, liquids, bottle labels, etc.) that occurs on a conveyor 14 belt during operation. This build up of foreign materials can interfere with the reflected infrared radiation signals 38 being received by the infrared radiation sensing system 16 and degrade sorting performance. Therefore, it is common for the belt surface to require periodic cleaning as a maintenance item—often once per shift. This cleaning requires manpower and time and is a maintenance cost. Also, in some sorting scenarios it is advantageous to determine color of item along with its infrared radiation signature. Many items to be sorted are transparent such as those made from polyethylene terephthalate (PET) or polystyrene (PS). The transparent item may have a color to it such as a green, blue, or amber PET bottle (for example). This color of a transparent item can be difficult for a sensing system 16 to distinguish if the item is on a conveyor 14 belt surface since the belt surface can be seen through the transparent item. For example, it can very hard to "see" the color of a PET bottle on a black conveyor 14 belt surface when lighted from above, especially "clear" bottles or lightly colored bottles such as light blue bottles. Additionally the build up of foreign materials on the belt can interfere with the color analyses degrading color sorting performance. Finally, the infrared radiation source 12 used in these systems is typically one or two banks of highly intense tungsten halogen lamps, positioned on the upstream and/or downstream sides of the infrared radiation sensing system 16, as shown in FIG. 1, with a very bright light output that has a strong near infrared radiation presence in the radiation spectrum. These lighting systems can quickly cause a large heat build-up on the conveyor 14 belt surface and any items present if the conveyor 14 belt is stopped with the belt surface area in the irradiated region stationary while the lamps are energized. There have been reports of fires being started in recycling facilities by such circumstances.

Figure 3:
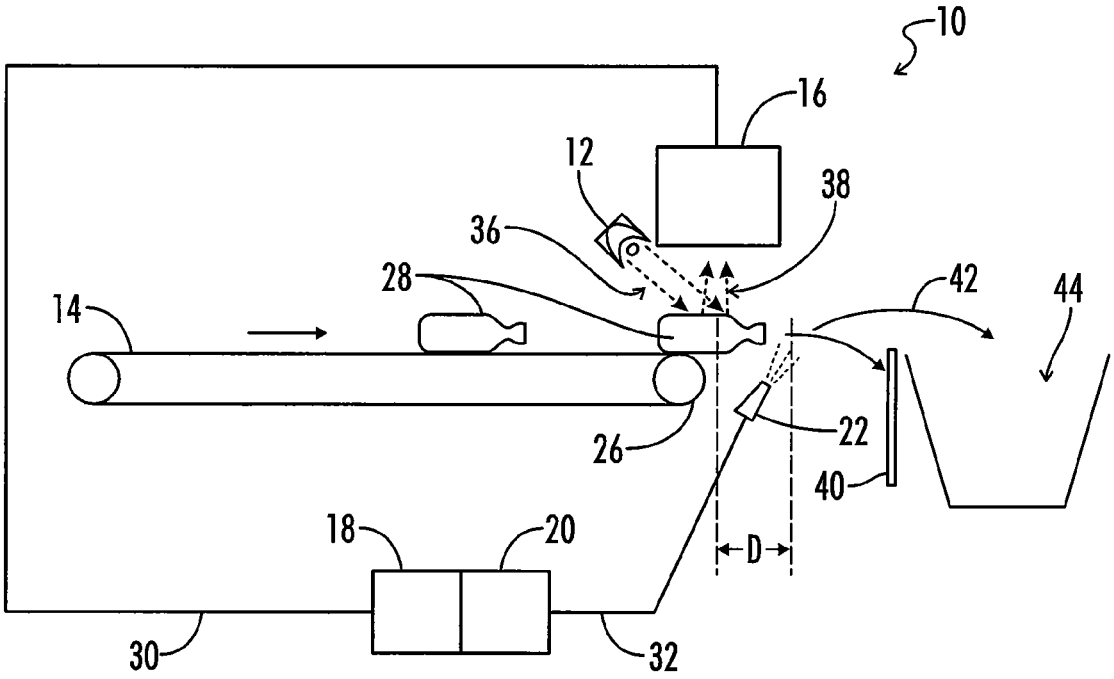
FIG. 3 is a schematic drawing of a side view of an embodiment of the sorting system disclosed herein. Shown therein is a conveyor transporting a sample to be sorted in the direction of the arrow. The vertical dashed lines represent the locations of the sensing region and the ejection region, being separated by a distance ("D"). The sensing region is immediately off the discharge end of the conveyor. The ejection region is only a matter of inches away from the sensing region.

Referring now to FIG. 3, there is an embodiment of the present invention. Shown there is a schematic diagram of a side view detailing the conveyor 14, which has a discharge end 26, that is moving in the direction of the arrow. Sample 28 is shown moving on the conveyor 14. After passing the discharge end 26 of the conveyor 14, the sample 28 is positioned to receive infrared radiation 36 from the infrared radiation source 12. The spectral characteristics of the reflected infrared radiation signal 38 contains information specific to the material samples 28 irradiated. Commercially available software to analyze infrared signals is available from LLA Instruments GmbH, Berlin, Germany. Infrared radiation sources 12 suitable for this use can be obtained from General Electric Company, Fairfield, Conn., and are well known and generally commercially available in the art. Infrared radiation is reflected 38 off the sample 28 and detected by the infrared radiation sensing system 16. Infrared radiation sensing systems 16 may be obtained from LLA Instruments GmbH, Berlin, Germany, and are well known and generally commercially available in the art. The infrared radiation sensing system 16 is operationally connected to the first processing system 18. One of ordinary skill in the art is familiar with the manner of operationally connecting components in detection systems as disclosed herein. All such wires, cables, and the like, needed for such operational connectivity are well known in the art and generally commercially available. Regarding each component of the system 10 disclosed herein, operational connectivity includes any connections necessary for power, data or information transfer, or the like, for the operation of the specific device. One of ordinary skill in the art is familiar with such types of connections. Note that U.S. Pat. No. 6,610,981 issued to Sommer, Jr. on Aug. 26, 2003 is hereby incorporated by reference in its entirety.

Figure 4:
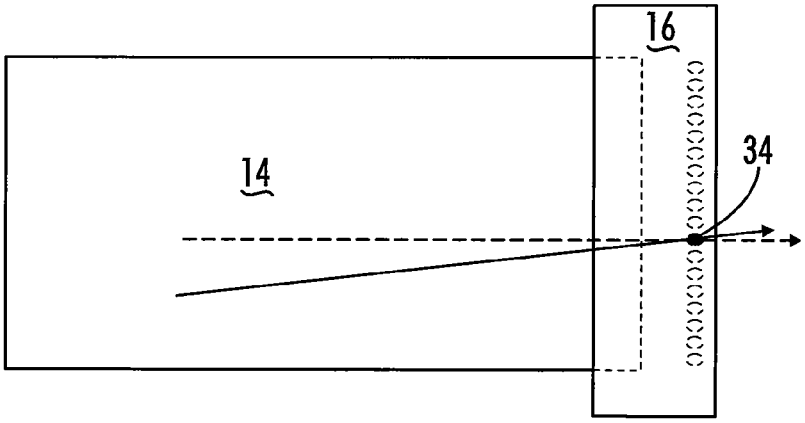
FIG. 4 is a schematic drawing of a top view of the embodiment of the invention shown in FIG. 3. Phantom lines are used to show the boundary of the conveyor and the ejectors which are located beneath the infrared radiation sensing system. Shown therein is an actual path of travel (solid arrow) of an item being sorted and an expected path of travel (dashed arrow) of that same item. The invention disclosed herein provides an improved sorting efficiency because of the small distance between the sensing region and the ejection region which allows for a single ejector to be fired (shaded ejector) to correctly eject an item even through the item's actual travel path and its expected travel path are not the same.

As further described below, the ejection system 22 is momentarily activated to eject an item selected for ejection after a delay time that depends upon the conveyor belt speed and the distance D between the sensing region and the ejection location. A typical application is the sorting of containers in a mixed recyclable container stream. The first processing system 18 is a microprocessor. Such a microprocessor may be a single microprocessor or a system of multiple microprocessors linked together to share computational tasks to enable high speed data processing. A suitable multiple microprocessor system is the Barcelona-HS available from Spectrum Signal Processing, Burnaby, Canada. The first processing system 18 is also operationally connected to a second processing system 20. Briefly, the ejection system 22 is controlled by the second processing system 20 which is responsive to information received from the first processing system 18. The second processing system 20 signals the ejection system 22 through connections 32 to selectively energize appropriate air ejectors within the ejection system 22 to deflect by short air blasts selected materials from the sample 28 flow. That is, the first processing system 18 provides and receives control signals to/from the infrared radiation sensing system 16 over an electrical/data connection 30. Data from the infrared sensing system 16 flows to first processing system 18 over connections 30 through an analog-to-digital conversion card so that digital data is presented to first processing system 18. A materials classification and sorting algorithm, or software, executes within the first processing system 18 to process the digital data and utilizes computer memory for storing data and accessing data during execution. According to results derived through executing the algorithm the second processing system 20 signals the ejection system 22, for example a bank of solid state relays such as those supplied by Opto22, Temecula, Calif., through DIO module to energize selected air ejectors within air ejector array of the ejection system 22. In practice it may be that the tasks performed by the first processing system 18 and the second processing system 20 may be performed by a single processor or a system of multiple processors. As best seen in FIG. 4, the ejection system 22 is positioned across the width of the trajectory path 42 of materials discharged off the end 26 of conveyor 14 and is an array of high speed air ejectors, such as the L2 series supplied by Numatics, Highland, Mich. The ejected item trajectory 42 results in the item passing over the splitter 40 and landing in a receiving station 44. In certain embodiments, a receiving station 44 may be an appropriately sized container for holding the sorted materials or a conveying system to remove ejected items from the sorting system 10. The materials of construction of the receiving station 44 are readily commercially available and well known in the sorting industry. Also, manufacturers are readily available for the manufacture of such goods, according to the known methods of manufacture within the industry. The user of the sorting system may chose through a standard control interface (not shown) alternate ejection settings, as would be know to those of ordinary skill in the art.

Still referring to FIG. 4, there is shown a schematic diagram of a top view of the system 10 disclosed herein. As shown therein, in certain embodiments of the invention, the infrared radiation sensing system 16 is positioned to receive reflected 38 infrared radiation as the sample 28 is located immediately off the discharge end 26 of the conveyor 14. In other embodiments, the infrared radiation sensing system 16 is positioned to receive reflected 38 infrared radiation as the sample 28 is located a minimal distance downstream from the discharge end 26 of the conveyor 14. A minimal distance is from about one inch to about six inches. In another embodiment, a minimal distance is about two inches. Still referring to FIG. 4, the solid arrow represents the actual path of travel of a specific item, which is in contrast to the dashed line which represents the expected path of travel of the specific item. The visual shows that a shorter distance between infrared radiation sensing and ejection allows for a single ejector 34 to be in both paths. That is, even if the expected path of travel of an item differs from the actual path of travel, when the infrared radiation sensing and ejection occur within a minimal distance, the two paths do not have an opportunity to diverge in such a short distance. Accordingly, the single ejector 34 is fired and properly ejects the item for which paths of travel are shown. If the ejector system 22 is located a further distance from the position at which infrared radiation is detected, then there is not a single ejector that is on both the actual and expected paths of travel.

Figure 5:
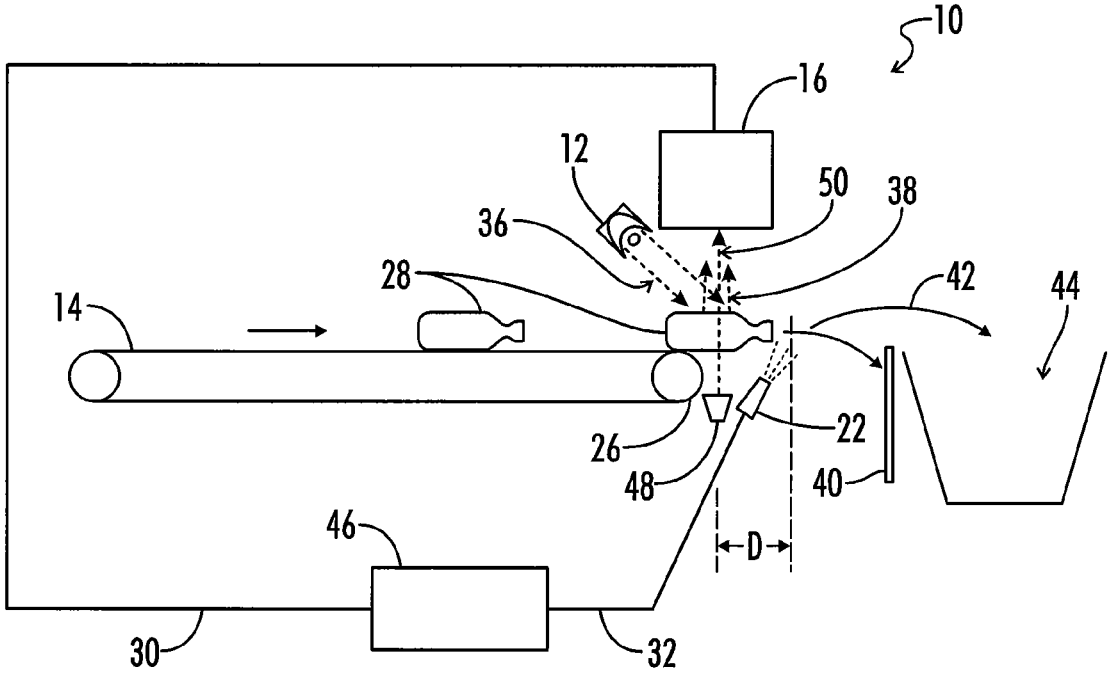
FIG. 5 is a schematic drawing of a side view of another embodiment of the sorting system disclosed herein. Shown therein is a conveyor transporting sample to be sorted. The sensing region is immediately off the discharge end of the conveyor. This embodiment of the invention has a transmission infrared radiation source located beneath the discharge end of the conveyor in addition to the reflective infrared radiation source of the embodiment shown in FIG. 3. The ejection region is positioned to be only a matter of inches away from the sensing region, in relation to the sample flow path, which is represented by the direction of the arrow on the conveyor.

Referring now to FIG. 5, there is shown a schematic diagram of a side view of another embodiment of the present invention. Shown therein is a system 10 additionally having a transmission infrared radiation source 48 located in line with the infrared radiation sensing system 16. The system 10 is capable of detection by transmission infrared radiation, reflection infrared radiation, or both. Such an additional transmission infrared radiation source 48 enables operating in transmission mode where a transmitted infrared radiation signal 50 processed by the infrared radiation sensing system 16 passes through the sample 28 being sensed. Such transmission sensing can be advantageous for identifying composition of transparent/translucent items such as PET bottles, and "natural" (i.e., not pigmented) HDPE (high density polyethylene), PP (polypropylene), and PS (polystyrene) materials since infrared radiation passing through a material can exhibit superior absorption at the material's signature frequencies than for reflected infrared radiation from the surface of the material thereby providing improved identification of the material. Similar to the embodiment of the invention shown in FIG. 3, the infrared radiation sensing system 16 shown in FIG. 5 is located immediately off the discharge end 26 of the conveyor 14 so that transmitted infrared radiation signal 50 may pass through sample 28 for detection by the sensing system 16. In alternate embodiments, rather than the transmission infrared radiation source 48 and sensing system 16 being located immediately off the discharge end 26 of the conveyor 14, they may be positioned a minimal distance downstream from the discharge end 26 of the conveyor 14. A minimal distance is from about one inch to about six inches. In another embodiment, a minimal distance is about two inches. In either embodiment, the conveyor 14 is not presented to the infrared radiation sensing system 16 as it was in previously existing units.

Still referring to FIG. 5, there is shown an embodiment of the present invention that uses a single processor system 46, rather than a combination of a first processing system 18 and a second processing system 20 and that performs tasks similar to those performed by first processing system 18 and second processing system 20. A single processor system 46 suitable for the current invention may be obtained from Dell, Round Rock, Tex. Such single processor systems 46 are known in the art and readily commercially available.

Disclosed herein is an embodiment of a method of sorting materials in order to overcome the above discussed disadvantages of the configuration shown in FIGS. 1 and 2, in addition to providing additional benefits. The method includes the use of a device having the infrared radiation sensing system 16 moved to a position off the discharge end 26 of the conveyor 14. An infrared radiation source 12 (reflection infrared radiation source, shown in FIG. 3) has been developed that provides focus of the impinging infrared radiation 36 into a narrow band that does not strike the conveyor 14 and that illuminates items to be sorted within the sensing region. The ejection system 22 is positioned a short distance downstream from the sensing region. In certain embodiments of the present invention, a short distance is about six inches, so that items to be ejected travel only the 6 inches before they are ejected over the splitter 40 and segregated from the main material flow.

This method has several advantages over currently available sorting methods. First, as described above, the shorter travel distance D compared to the traditional method of using the device shown in FIG. 1 minimizes effects upon ejection accuracy due to changes in sample 28 speed with respect to conveyor 14 speed due to bouncing, rolling, and the like. The detrimental effect on ejection timing due to changes in speed gets worse over time since the sample 28 gets further and further away from the target arrival time at the ejection system 22. The short distance of the presently disclosed invention minimizes the time from detection to ejection, thus minimizing the detrimental effect.

Second, the short travel distance D provided in the currently disclosed method of using the device disclosed herein as compared to the traditional method of using the device shown in FIG. 1 minimizes effects upon ejection accuracy due to lateral motion of an item to be ejected. The time from detection to ejection is considerably shortened by using the device shown in FIG. 3, as compared to using the device shown in FIG. 1, which minimizes the amount of time that an item to be ejected strays out of its expected path before ejection.

Third, build up of foreign materials on the conveyor 14 do not interfere with the infrared radiation signals 38 being received by the infrared radiation sensing system 16 since the conveyor 14 surface is no longer presented to the infrared radiation sensing system 16. Fourth, interference of the conveyor 14 surface with color determination of transparent items (e.g., PET bottles) is eliminated since the sample 28 being sensed is no longer on the conveyor 14 surface and instead is located off the discharge end 26 of the conveyor 14. Fifth, the potential for fire resulting from the intense radiation from the infrared radiation source 12 is minimized since the infrared radiation 36 emanating from the source 12 is directed into the "free air" sensing region, which is off the discharge end 26 of the conveyor 14. In the event the conveyor 14 stops, sample 28 will not stop suspended in air in the sensing region but will pass on through due to its intrinsic trajectory. Therefore, there will be no conveyor 14 surface or stationary sample 28 in the irradiated sensing region while the conveyor 14 is stopped or at any other time. Finally, another advantage to the method disclosed herein is the ability to add a transmission infrared radiation source 48 below the sample 28 feed stream as it discharges off the discharge end 26 of the conveyor 14. In the examples shown in FIG. 1 and FIG. 2 it is not possible to add a transmission infrared radiation system for sensing at the same location along the sample 28 path of travel as is located the reflection infrared sensing system 16 since the conveyor belt is in the way.

This patent application expressly incorporates by reference all patents, references, and publications disclosed herein.

Although the present invention has been described in terms of specific embodiments, it is anticipated that alterations and modifications thereof will no doubt become apparent to those skilled in the art. It is therefore intended that the following claims be interpreted as covering all alterations and modifications that fall within the true spirit and scope of the invention.

What is claimed is:

1. A method of sensing and sorting materials according to composition, comprising:

providing a sample;

placing the sample on a conveyor having a discharge end;

placing the sample in an infrared radiation sensing region, wherein the infrared radiation sensing region is located immediately off the discharge end of the conveyor;

irradiating the sample to be sorted with infrared radiation in the sensing region;

detecting infrared radiation signals reflected off the sample while the sample is located immediately off the discharge end of the conveyor;

analyzing the infrared radiation signals to determine composition of the sample;

energizing at least one air ejector of an air ejection array, wherein the air ejection array is located immediately downstream from the infrared radiation sensing region.

2. The method of claim 1, wherein the infrared radiation sensing region is located at a minimal distance from the discharge end of the conveyor.

3. The method of claim 1, wherein the air ejection array is located at a minimal distance downstream from the infrared radiation sensing region.

4. The method of claim 1, further comprising detecting infrared radiation signals transmitted through the sample while the sample is in the sensing region.

5. A sorting device for sorting materials according to composition, comprising:

an infrared radiation source;

a conveyor, wherein the conveyor has a discharge end;

an infrared radiation sensing system positioned to receive and detect infrared radiation reflected off a sample while the sample is located immediately off the discharge end of the conveyor and is irradiated with infrared radiation from the infrared radiation source;

a first processing system operationally connected to the infrared radiation sensing system so that the detected infrared radiation signals are analyzed to determine composition of the sample;

an ejection system positioned immediately downstream from the infrared radiation sensing system;

a second processing system operationally connected to the ejection system so that sample having certain composition may be ejected out of the flow path by the ejection system;

a receiving station positioned to receive ejected sample.

6. The device of claim 5, wherein the infrared radiation sensing system is located a minimal distance downstream from the discharge end of the conveyor.

7. The device of claim 5, wherein the ejection system is located a minimal distance downstream from the infrared radiation sensing system.

8. The device of claim 5, wherein the first processing system and the second processing system are combined into a single processing system.

9. A sorting device for sorting materials according to composition, comprising:

an infrared radiation source;

a conveyor, wherein the conveyor has a discharge end;

an infrared radiation sensing system positioned to receive and detect infrared radiation reflected off a sample while the sample is located immediately off the discharge end of the conveyor and is irradiated with infrared radiation from the infrared radiation source;

a processing system operationally connected to the infrared radiation sensing system so that the detected infrared radiation signals are analyzed to determine composition of the sample;

an ejection system operationally connected to the processing system so that a sample having a certain composition may be ejected out of the flow path, wherein the ejection system is positioned immediately downstream from the infrared radiation sensing system;

a receiving station positioned to receive ejected sample.

10. The device of claim 9, further comprising a transmission infrared radiation source positioned so that the infrared radiation sensing system receives and detects infrared radiation transmitted through the sample while the sample is located immediately off the discharge end of the conveyor and is irradiated with infrared radiation from the transmission infrared radiation source.

* * * * *